US007312185B2

(12) United States Patent
Willey et al.

(10) Patent No.: US 7,312,185 B2
(45) Date of Patent: Dec. 25, 2007

(54) ROCK BIT GREASE COMPOSITION

(75) Inventors: Thomas F. Willey, Aliso Viejo, CA (US); Ryan J. Willey, Fullerton, CA (US); Scott T. Willey, Stanton, CA (US)

(73) Assignee: Tomlin Scientific Inc., Santa Ana, CA (US)

( * ) Notice: Subject to any disclaimer, the term of this patent is extended or adjusted under 35 U.S.C. 154(b) by 267 days.

(21) Appl. No.: 10/699,237

(22) Filed: Oct. 30, 2003

(65) Prior Publication Data

US 2004/0092408 A1 May 13, 2004

Related U.S. Application Data

(60) Provisional application No. 60/423,325, filed on Oct. 31, 2002.

(51) Int. Cl.
*B01F 17/00* (2006.01)

(52) U.S. Cl. ..... 508/165; 508/150

(58) Field of Classification Search ..... 508/165, 508/150

See application file for complete search history.

(56) References Cited

U.S. PATENT DOCUMENTS

| | | | | |
|---|---|---|---|---|
| 2,736,700 | A | 2/1956 | Graham, Jr. et al. | 252/25 |
| 3,062,741 | A | 9/1962 | Crowl | 252/25 |
| 3,170,878 | A | 2/1965 | Armstrong | 252/18 |
| 3,281,355 | A | 10/1966 | Cyphers et al. | 252/18 |
| 3,384,582 | A | 5/1968 | Groszek | 252/25 |
| 3,935,114 | A | 1/1976 | Donahu, Jr. et al. | 252/18 |
| 4,409,112 | A | 10/1983 | Urmy, Jr. | 252/33.4 |
| 4,827,064 | A * | 5/1989 | Wu | 585/10 |
| 5,015,401 | A | 5/1991 | Landry et al. | 252/18 |
| 5,177,284 | A | 1/1993 | Le et al. | 585/455 |
| 5,457,254 | A | 10/1995 | Ardito et al. | 585/455 |
| 5,589,443 | A | 12/1996 | Denton et al. | 508/150 |
| 5,668,092 | A | 9/1997 | Denton | 508/146 |
| 5,773,391 | A * | 6/1998 | Lawate et al. | 508/257 |
| 5,891,830 | A | 4/1999 | Koltermann | 308/136 |
| 6,056,072 | A | 5/2000 | Koltermann et al. | 175/227 |
| 6,239,085 | B1 * | 5/2001 | Slack | 508/539 |

OTHER PUBLICATIONS

Encyclopedia of Chemical Technology, Kirk-Othmer, 2nd Ed., A. Standen, Editor, Interscience Publisher, John Wiley and Sons, Inc., New York, N.Y., 1967, pp. 582-587.

Modern Lubricating Greases, by C. J. Boner, Scientific Publications (GB) Limited, Chapter 4, Sep. 1987.

* cited by examiner

*Primary Examiner*—Edward J. Cain
(74) *Attorney, Agent, or Firm*—Knobbe Martens Olson & Bear LLP

(57) ABSTRACT

A grease for rock bit lubrication and other high temperature bearing applications is provided comprising a high viscosity index polyalphaolefin synthetic base fluid in combination with an alkylated naphthalene base fluid.

66 Claims, No Drawings

ROCK BIT GREASE COMPOSITION

RELATED APPLICATION

This application claims the benefit of U.S. Provisional Application No. 60/423,325, filed Oct. 31, 2002.

FIELD OF THE INVENTION

This invention relates to a grease for rock bit bearings. In particular, it relates to a grease composition comprising high viscosity index polyalphaolefin (HVI PAO) synthetic base fluids.

BACKGROUND OF THE INVENTION

One of the greatest challenges in the formulation of specialty lubricants for drilling applications is the prevention of drill bit bearing wear in subterranean formations. In such applications, lubrication takes place in an abrasive environment of mud and rock particles deep below the earth's surface. The journal bearings are subject to extremely high loads, because the bit generally turns at slow speeds and has the weight of the drill string on top of it. Furthermore, there is shock loading due to the bouncing and vibrating of the drill string.

SUMMARY OF THE INVENTION

Because all of the power delivered to the bit must be transferred through the bearings, a grease that minimizes scoring, galling, and wear of the bearing surfaces is highly desirable. Moreover, under certain geothermal steam drilling conditions, the operating temperature of the lubricating grease in the rock bit can exceed 300° F. (149° C.). A grease that can function at such harsh temperatures and which possesses extremely good thermal and oxidative stability is therefore desirable. Accordingly, a grease composition for rock bit lubrication and other applications is provided.

Synthetic greases have considerable advantages over conventional hydrocarbon based greases. The advantages for synthetics in the use of rock bits include high viscosity with good pumpability, lower torque, ability to function at lower operating temperatures, and excellent thermal and oxidative stability. Many of these advantages are due to the controlled synthesis that yields products of exact properties. These superior benefits have led to the development of many commercial synthetic types of grease for a variety of uses. These commercially available products are competitively priced and readily available with high viscosities and weld loads. However, they are not ideal for use in journal and roller bearings within a rock bit and are generally of limited applicability due to one or more of the following: the product may not be commercially available deaerated; no product modification as designs change may be permitted; such products may not be designed specifically for sealed tri-cone rock bits; the product may be limited to the type of soap (thickener) and base fluid.

Accordingly, a custom formulated synthetic rock bit grease that is readily available is desirable, especially a rock bit grease exhibiting an ability to operate at temperatures of 300° F. or higher for at least 300 hours, having elastomer compatibility and conditioning, thermal and oxidative resistance, and high load carrying capacity.

The greases of preferred embodiments can employ a combination of complimentary synthetic base fluids, with one typically being low viscosity and the other being high.

By employing such a combination of base oils, a wide range of viscosities can be obtained by adjusting the relative proportions of the base oil components. The greases of preferred embodiments can possess numerous advantages when compared to conventional greases. High viscosity synthetic fluids contain low traction coefficient properties that lower torque and reduce heat by limiting the colliding asperities in the contact region. Reduced heat produces longer life for all internal components including the grease, and lower heat combined with the lubrication from the lower viscosity fluid increase elastomer life. Greases of preferred embodiments can employ a nonreactive lubricating solids package replacing conventional active sulfur, phosphorus, zinc, and chlorine additives. Advantages to a nonreactive lubricating solids package include avoiding the adverse effects on elastomers exhibited by sulfur at high temperatures, increased load carrying capacity, for example, up to at least 800 kg, and that inactive ingredients do not produce byproducts that propagate oxidation. Greases of preferred embodiments can also possess a high soap content, which increases Elastohydrodynamic Lubrication (EHL), which aids in reducing operating temperature and which increases load carrying capacity and apparent viscosity. The greases of preferred embodiments can also contain no toxic substances such as lead, chlorine, or antimony.

In a first embodiment, a grease composition for lubricating a rock bit for drilling subterranean formations or for lubricating a high temperature bearing is provided, the grease comprising a high viscosity index polyalphaolefin base fluid, wherein the polyalphaolefin contains an average of 30 to 100 carbon atoms, a branching ratio of less than about 0.19, and an average side chain length of 8 or more carbon atoms, wherein the high viscosity index polyalphaolefin base fluid comprises from about 15 wt. % to about 85 wt. % of the grease composition; an additional base fluid selected from the group consisting of monosubstituted alkyl naphthalenes, polysubstituted alkyl naphthalenes, and mixtures thereof, wherein the alkyl comprises from about 16 to about 30 carbon atoms, wherein the additional base fluid comprises from about 15 wt. % to about 85 wt. % of the grease composition; an ester base fluid, the ester comprising from about 5 to about 20 carbon atoms, wherein the ester base fluid comprises from about 0.5 wt. % to about 5 wt. % of the grease composition; a metal complex soap, the soap comprising a residue of one or more fatty acids comprising from 2 to 22 carbon atoms, wherein the metal is selected from the group consisting of calcium, lithium, sodium, barium, titanium, and mixtures thereof, wherein the metal soap comprises from about 5 wt. % to about 45 wt. % of the grease composition; an antioxidant, wherein the antioxidant comprises from about 0.2 wt. % to about 2 wt. % of the grease composition; a metal deactivator, wherein the metal deactivator comprises from about 0.1 wt. % to about 1.5 wt. % of the grease composition; an antiwear agent, wherein the antiwear agent comprises from about 0.1 wt. % to about 15 wt. % of the grease composition; and a bismuth oxide extreme pressure additive, wherein the bismuth oxide extreme pressure additive comprises from about 1 wt. % to about 20 wt. % of the grease composition.

In a second embodiment, a grease composition for lubricating a rock bit for drilling subterranean formations or for lubricating a high temperature bearing is provided, the grease comprising a high viscosity index polyalphaolefin, wherein the high viscosity index polyalphaolefin has an average side chain length of 8 or more carbon atoms.

In a third embodiment, a grease composition for lubricating a rock bit for drilling subterranean formations or for lubricating a high temperature bearing is provided, the grease comprising a high viscosity index polyalphaolefin, wherein the high viscosity index polyalphaolefin has a branching ratio of less than about 0.19.

In an aspect of the third embodiment, a number average molecular weight Mn of the high viscosity index polyalphaolefin is from about 3400 to about 22000.

In an aspect of the third embodiment, the grease comprises from about 20 wt. % to about 50 wt. % of the high viscosity index polyalphaolefin.

In an aspect of the third embodiment, the grease further comprises a naphthalene substituted by an alkyl group.

In an aspect of the third embodiment, the grease further comprises a naphthalene substituted by a single alkyl group.

In an aspect of the third embodiment, the alkyl group of the alkylated naphthalene comprises from about 16 to about 30 carbon atoms.

In an aspect of the third embodiment, the grease comprises from about 30 wt. % to about 80 wt. % of the naphthalene substituted by an alkyl group.

In an aspect of the third embodiment, the grease further comprises an ester base fluid.

In an aspect of the third embodiment, the ester of the ester base fluid comprises from about 5 to about 20 carbon atoms.

In an aspect of the third embodiment, the grease comprises from about 0.5 wt. % to about 5 wt. % of the ester base fluid.

In an aspect of the third embodiment, the grease further comprises a metal complex soap.

In an aspect of the third embodiment, the metal complex soap is derived from a fatty acid comprising from about 2 to about 22 carbon atoms.

In an aspect of the third embodiment, the grease comprises from about 5 wt. % to about 45 wt. % of the metal complex soap.

In an aspect of the third embodiment, the metal of the metal complex soap is selected from the group consisting of alkaline earth metals, alkali metals, Group IIB metals, Group IIIA metals, Group IVA metals, Group VA metals, Group IVB metals, Group VB metals, and mixtures thereof.

In an aspect of the third embodiment, the metal of the metal complex soap is selected from the group consisting of lithium, sodium, potassium, magnesium, strontium, barium, aluminum, titanium, bismuth, and mixtures thereof.

In an aspect of the third embodiment, the metal of the metal complex soap comprises calcium.

In an aspect of the third embodiment, the metal of the metal complex soap comprises a compound selected from the group consisting of metal hydroxides, metal oxides, metal isopropoxides, and mixtures thereof.

In an aspect of the third embodiment, the grease comprises a non-soap thickener.

In an aspect of the third embodiment, the non-soap thickener selected from the group consisting of a polyurea thickener, a silica gellant, a polytetrafluoroethylene, a clay, and mixtures thereof.

In an aspect of the third embodiment, the grease comprises from about 3 wt. % to about 40 wt. % non-soap thickener.

In an aspect of the third embodiment, the grease further comprises from about 0.2 wt. % to about 2 wt. % of an antioxidant.

In an aspect of the third embodiment, the grease further comprises from about 0.2 wt. % to about 2 wt. % of a phenolic antioxidant.

In an aspect of the third embodiment, the grease further comprises from about 0.2 wt. % to about 2 wt. % of an amine antioxidant.

In an aspect of the third embodiment, the grease further comprises from about 0.02 wt. % to about 1.5 wt. % of a metal deactivator selected from the group consisting of substituted benzotriazole, derivatives of substituted benzotriazole, and mixtures thereof.

In an aspect of the third embodiment, the metal deactivator consists essentially of benzotriazole.

In an aspect of the third embodiment, the grease comprises from about 0.02 wt. % to about 1.5 wt. % benzotriazole.

In an aspect of the third embodiment, the grease further comprises from about 0.1 wt. % to about 8 wt. % of a polytetrafluoroethylene antiwear agent.

In an aspect of the third embodiment, the grease further comprises from about 2 wt. % to about 25 wt. % of a molybdenum disulfide extreme pressure additive.

In an aspect of the third embodiment, the grease further comprises from about 1 wt. % to about 20 wt. % of a bismuth oxide extreme pressure additive.

In an aspect of the third embodiment, the grease further comprises from about 1 wt. % to about 30 wt. % of an extreme pressure additive.

In an aspect of the third embodiment, the grease further comprises an anti-seize agent.

In an aspect of the third embodiment, the anti-seize agent comprises copper powder.

In an aspect of the third embodiment, the grease comprises from about 3 wt. % to about 9 wt. % of the anti-seize agent.

In a fourth embodiment, a grease composition for lubricating a rock bit for drilling subterranean formations or for lubricating a high temperature bearing is provided, the grease comprising a base fluid, the base fluid consisting essentially of an ester base fluid, wherein the ester base fluid comprises an ester selected from the group consisting of pentaerythritol ester, dipentaerythritol ester, trimellitate ester, and mixtures thereof; and from about 10 wt. % to 45 wt. % of a calcium complex soap, the soap comprising a residue of one or more fatty acids comprising from about 2 to about 22 carbon atom.

In a fifth embodiment, a rock bit for drilling subterranean formations is provided, the rock bit comprising a bit body, the bit body comprising a plurality of journal pins each comprising a bearing surface; a cutter cone mounted on each journal pin with a journal bearing surface; and a grease stored in a pressure-compensated reservoir in contact with the journal bearing surface, the grease comprising a high viscosity index polyalphaolefin, wherein the polyalphaolefin has a branching ratio of less than about 0.19.

In a sixth embodiment, a method for lubricating a rock bit for drilling subterranean formations, the rock bit comprising a body and a plurality of cutter cones mounted, the cutter cones mounted on the body, the rock bit comprising a journal bearing in contact with a grease reservoir, the method comprising evacuating a portion of the rock bit comprising the journal bearing; and introducing a grease into the evacuated area, the grease comprising a high viscosity index polyalphaolefin, wherein the polyalphaolefin has an average side chain length of 8 or more carbon atoms.

In a seventh embodiment, a method for lubricating a rock bit for drilling subterranean formations is provided, the rock bit comprising a body and a plurality of cutter cones mounted, the cutter cones mounted on the body, the rock bit comprising a journal bearing in contact with a grease reservoir, the method comprising evacuating a portion of the rock bit comprising the journal bearing; and introducing a grease into the evacuated area, the grease comprising a high viscosity index polyalphaolefin, wherein the polyalphaolefin has a branching ratio of less than about 0.19.

DETAILED DESCRIPTION OF THE PREFERRED EMBODIMENT

The following description and examples illustrate a preferred embodiment of the present invention in detail. Those of skill in the art will recognize that there are numerous variations and modifications of this invention that are encompassed by its scope. Accordingly, the description of a preferred embodiment should not be deemed to limit the scope of the present invention.

Grease Formulations

Various compositions and components thereof suitable for use in rock bit lubrication and other lubricating applications are known. See, e.g., Encyclopedia of Chemical Technology, Kirk-Othmer, Second Edition, A. Standen, Editor, Interscience Publishers, John Wiley and Sons, Inc., New York, N.Y., 1967, pages 582-587; Modern Lubricating Greases, by C. J. Boner, Scientific Publications (GB) Limited, Chapter 4; U.S. Pat. Nos. 3,062,741; 3,170,878; 3,281,355; 3,384,582; 6,056,072; 5,891,830; 5,668,092; 5,589,443; 5,015,401; 4,409,112; 3,935,114; 4,827,064; 5,177,284; 2,736,700; and 3,935,114. Rock bit bearings are generally lubricated with greases to assist the seals in keeping out the drilling muds. Greases are prepared by adding a thickener to a lubricating oil. Thickeners comprising soaps are generally preferred. The soap is formed via a saponification reaction between a fatty acid and metal hydroxide, metal oxide, metal isopropoxide, or the like.

The oil or base fluid can include any number of materials, which are typically divided into two groups: mineral oils, which are petroleum derived; and synthetic fluids, which are generally chemical reaction products. Synthetic fluids including polyalphaolefins (PAOs), alkylated naphthalenes, and esters have been used in compounding oil-based products. There are two different classes of alkylated naphthalenes: monoalkylated and polyalkylated naphthalenes. It is well known in the art that the monoalkylated naphthalenes are generally more thermally stable and oxidatively stable than the polyalkylated naphthalenes. Another fluid that is similar in structure to alkylated naphthalene is alkylated benzene, which has been used to formulate oil products. Alkylated benzene oils are typically used in regions with cold climates, such as Alaska, in the wintertime. With the exception of esters, these synthetic fluids are generally not used in greases. Other base oils or fluids that can be employed include Unconventional Base Oils (UCBOs) and High Viscosity Index (HVI) paraffinic base oils.

A finished grease typically includes various additives, such as additives for extreme pressure (EP), antiwear, corrosion, solubility, anti-seize protection, oxidation protection, and the like. The EP agents protect the metal surfaces under heavy loads. There are two types of EP agents: EP agents that activate at high temperatures, such as lead dithiocarbamate, organosulfur compounds, organophosphorus sulfur compounds, and organophosphorus sulfur chlorine compounds; and solid EP agents, such as molybdenum disulfide, graphite, metal oxides, and powered metals such as copper and lead. Particles of solid EP agents form layers between the two bearing surfaces and protect them under load sliding against each other in a way similar to cards in a stack sliding against each other.

A preferred anti-seize agent is copper powder. Anti-seize agents, when employed, preferably comprise from about 3 wt. % or less to about 9 wt. % or more of the grease, more preferably from about 4, 5, or 6 wt. % to about 7, 8, or 9 wt. %.

Antiwear additives can also be classified according to two categories: those activated at a lower temperature than EP additives, such as zinc dialkyl dithiophosphate, sorbitan monoleate, chlorinated hydrocarbons, and phosphate esters; and those activated at lower loads than EP additives, such as polytetrafluoroethylene (PTFE), tetrafluoroethylene (TFE), and antimony trioxide.

Preferred metal deactivators for rock bits include benzotriazole, and its derivatives. Metal deactivators mainly protect against nonferrous corrosion. However, they can provide some degree of protection against ferrous corrosion as well. Ferrous corrosion inhibitors include alkylated organic acid and esters, organic acids, phenates, and sulfonates.

Common solubility aids, which solublize the additives into the oil or soap, include esters, such as polyol esters, monoesters, diesters, and trimellitate esters.

Antioxidants typically used in grease formulations include substituted diphenylamines, amine phosphates, aromatic amines, butylated hydroxytoluene, phenolic compounds, zinc dialkyl dithiophosphates, and phenothiazine. When a grease is utilized to lubricate a rock bit, it is generally preferred not to employ a zinc dialkyl dithiophosphate antioxidant if the rock bit comprises an incompatible metal, e.g., silver. In other lubricating applications, however, zinc dialkyl dithiophosphates can be preferably employed as antioxidants.

Other additives that can be utilized in grease formulations include polybutenes for tackiness. In addition, viscosity index improvers, which help to extend the operating range of the grease, are sometimes used. Typical viscosity index improvers include polybutene and polyisobutylene polymers. Silicones or polymers can also be incorporated as antifoam agents and/or air entraimnent aids. A variety of dyes can also be used to impart color to the grease. In addition, odor maskers such as pine oil can also be employed.

Rock bit bearing greases preferably meet certain established criteria and provide lubrication and protection adequate for operating temperatures up to, e.g., about 150° C. and higher. Greases suitable for use in lubricating rock bit bearings preferably have a worked penetration (as measured by ASTM D-217) of no less than 265, and a National Lubricating Grease Institute (NLGI) classification of less than Class 3.

Preferred Process for Formulating the Grease

The greases of preferred embodiments generally include a synthetic fluid base oil, an alkali or alkaline earth complex soap base thickener, bismuth oxide or hydroxide extreme pressure agents, molybdenum disulfide extreme pressure agents, PTFE, metal deactivators, and antioxidant additives.

The grease compositions of preferred embodiments are preferably prepared by first combining synthetic lubricant base oils, preferably an alkylated naphthalene and HVI PAO. The HVI PAO, which has a more branched structure when compared to conventional PAOs, imparts superior performance characteristics to the grease. The HVI PAO preferably has a viscosity at 100° C. of from about 150 cSt or lower to about 1000 cSt or higher. The alkylated naphthalene preferably has a viscosity at 100° C. of from about 3 cSt or lower to about 13 cSt or higher. In certain embodiments, it can be desirable to add a polyol ester as an additional synthetic lubricant base oil. The polyol ester can provide improved solubility for certain additives in the oil. In preferred embodiments, the base fluid blend generally comprises from about 15 wt. % or less to about 85 wt. % or more alkylated naphthalene, from about 0.5 wt. % or less to about 70 wt. % or more polyol ester, and from about 15 wt. % or less to about 85 wt. % or more HVI PAO. Preferably, the base fluid blend comprises from about 20 wt. % to about 60 wt. % alkylated naphthalene, from about 0.5 wt. % to about 30, 35, 40, 45, 50, 55, 60, or 65 wt. % polyol ester, and from about 40 wt. % to about 80 wt. % HVI PAO; more preferably from about 25 or 30 wt. % to about 50 or 55 wt. % alkylated naphthalene, from about 1 wt. % to about 20 wt. % polyol ester, and from about 45 or 50 wt. % to about 70 or 75 wt. % HVI PAO; and most preferably from about 35 or 40 wt. % to about 45 wt. % alkylated naphthalene, from about 2, 3, 4, 5, 6, 7, 8, 9 or 10 wt. % to about 11, 12, 13, 14, 15, 16, 17, 18, or 19 wt. % polyol ester, and from about 55 or 60 wt. % to about 65 wt. % HVI PAO.

Preferred base fluid blends typically comprise a high viscosity component and a low viscosity component. Preferably, the HVI PAO is the high viscosity component, and the low viscosity component is an alkylated naphthalene. However, other base fluids can be suitable for use as either the high or the low viscosity component. When a high and a low viscosity component are used in combination, the low viscosity component typically comprises from about 1 wt. % or less to about 50 wt. % or more of the base oil blend, preferably from about 2 wt. % to about 30 or 40 wt. % of the base oil blend, and most preferably from about 5, 10, or 15 wt. % to 20 or 25 wt. % of the base oil blend. The high viscosity component preferably has a viscosity at 100° C. of from about 100 to about 5000 cSt, preferably from about 105, 110, 115, 120, 125, 130, 135, 140, 145, 150, 155, 160, 165, 170, 175, 180, 185, 190, 195 or 200 cSt to about 1000, 1500, 2000, 2500, 3000, 3500, 4000, or 4500 cSt, and most preferably from about 225, 250, 275, 300, 325, 350, 375, 400, 425, 450, 475, or 500 cSt to about 550, 600, 650, 700, 750, 800, 850, or 900 cSt. The low viscosity component preferably has a viscosity at 100° C. of from about 1 to about 50 cSt, preferably from about 2, 3, 4, or 5 cSt to about 25, 30, 35, 40, or 45 cSt, and most preferably from about 6, 7, 8, 9, 10, 11, 12, 13, 14 or 15 cSt to about 16, 17, 18, 19, or 20 cSt.

After the synthetic fluid base oils are blended, a metal complex soap is added to thicken the oil. The metal complex soap is typically prepared by blending the synthetic base oils with one or more carboxylic acids and one or more hydroxides, oxides, or isopropoxides of alkali metals, alkaline earth metals, IVB metals, or other metals. Preferred carboxylic acids include fatty acids, particularly fatty acids containing from about 2 to about 22 carbon atoms, including C2, C4, C6, C8, C10, C12, C14, C16, C18, C20, and C22 carboxylic acids. Such carboxylic acids preferably comprise an unsubstituted, saturated, straight chain hydrocarbyl group, however, in certain embodiments branched or cyclic groups can be employed, one or more bonds of the hydrocarbyl group can be unsaturated, the hydrocarbyl group can incorporate aromatic moieties, or one or more hydrogen atoms of the hydrocarbyl group can be substituted, e.g., by a hydroxy or other functional group. The carboxylic acid can be a monocarboxylic acid, a dicarboxylic acid, a tricarboxylic acid, or a polycarboxylic acid. A single carboxylic acid or two or more carboxylic acids can be employed. Alkali metals include but are not limited to lithium, sodium, and potassium. Alkaline earth metals include but are not limited to calcium, magnesium, strontium, and barium. Group IVB metals include, but are not limited to titanium. Other suitable metals for use in the metal complex soap include aluminum. A single metal or combination of two or more metals can be employed. The metal complex soap preferably constitutes from about 5 wt. % or less to about 45 wt. % or more of the total grease composition, more preferably from about 6, 7, 8, 9, 10, 11, 12, 13, 14, or 15 wt. % to about 35, 36, 37, 38, 39, 40, 41, 42, 43, or 45 wt. % and most preferably from about 16, 17, 18, 19, 20, 21, 22, 23, or 24 wt. % to about 25, 26, 27, 28, 29, 30, 31, 32, 33, or 34 wt. %.

The components of the formulation other than the base oil typically make up about 1 wt. % or less to about 40 wt. % or more of the total formulation. PTFE, bismuth oxide or hydroxide, and/or molybdenum disulfide are typically added to the formulation at levels sufficient to impart improved antiwear performance. The compositions of preferred embodiments are generally not harmful to rock bit seals and boots, and are preferably free of hazardous materials considered harmful to the environment or toxic to humans.

In a particularly preferred embodiment, the grease comprises the following elements.

The High Viscosity Index Polyalphaolefin Base Fluid

It is desirable for a base oil for use in rock bit lubrication and other high temperature applications to possess a high viscosity index. A high viscosity index helps ensure a good film separating the journal bearings throughout the temperature range of the drilling operation. The separation of the journal bearings reduces wear of the metal surfaces, and extends the life of the rock bits. Accordingly, the greases of preferred embodiments incorporate a synthetic fluid base oil possessing a high viscosity index, namely a HVI PAO. HVI PAOs provide superior lubricating performance than many other base oils. The higher viscosity indices of the HVI PAOs correspond to a higher film strength and lower wear. The lower pour points of HVI PAOs also make them suitable for use at lower temperatures than other base oils of the same high temperature viscosity (i.e., the viscosity at 40° C. or 100° C., temperatures at which viscosities are typically measured for comparison purposes).

Particularly preferred HVI PAOs include those disclosed in U.S. Pat. No. 4,827,064. HVI PAOs exhibit different performance characteristics than conventional PAOs. For example, HVI PAOs possess a higher viscosity index than conventional PAOs of similar molecular weight. HVI PAOs generally exhibit higher film strengths than conventional PAOs, and thus provide superior protection against wear at high temperatures, such as the temperatures characteristically encountered in subterraneous drilling. HVI PAOs are generally of higher viscosity than conventional PAOs of similar molecular weight, but exhibit lower pour points than the corresponding conventional PAO. For example, a HVI PAO with a viscosity of 150 cSt at 100° C. typically has a pour point of about −42° C. In contrast, a conventional PAO having a viscosity of 100 cSt at 100° C. typically has a pour point of −33° C. These results are unusual, since a higher viscosity generally correlates with a higher pour point. The lower pour point of HVI PAOs makes them suitable for use at a lower temperatures than conventional PAOs. HVI PAOs also exhibit superior oxidative stability than conventional PAOs, as measured by Differential Scanning Calorimetry (DSC).

The structure of a HVI PAO as well as its method of manufacture is different from those of a conventional PAO. HVI PAOs are characterized by a uniform molecular structure with low branch ratios. The branch ratio is the ratio of methyl (—$CH_3$) to methylene (—$CH_2$—) moieties in the molecular structure. HVI PAOs typically possess a branch ratio of less than about 0.19, while conventional PAOs branch possess a branch ratio greater than 0.2. The branching characteristic of a conventional PAO and a HVI PAO is illustrated in the molecular structures of the following figures.

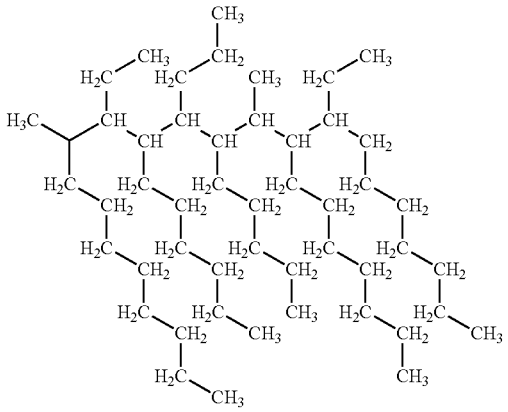

Conventional PAO

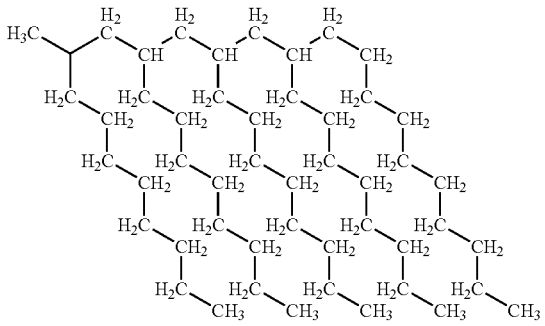

HVI PAO

The catalyst typically employed to manufacture HVI PAOs is reduced chromium, a different catalyst than boron trifluoride and aluminum trichloride typically used to prepare conventional PAOs. The polymerization reaction by which conventional PAOs are prepared generally results in the formation of many different isomers and structures. In contrast, the polymerization reaction by which HVI PAOs are formed is generally highly specific, resulting in a low number of isomers formed. The resulting HVI PAO product oligomers have an atactic molecular structure of mostly head-to-tail attachments, with some head-to-head connections.

HVI PAOs can generally be manufactured to higher viscosities than conventional PAOs while still retaining viscometric properties making them suitable for use as lubricants. The viscosity of a lubricating composition is influenced by temperature. Generally, as the temperature increases, the viscosity or the resistance to flow decreases. Thus, a lubricating composition's ability to form a protective film for the interacting metal surfaces decreases as the temperature increases. The fluid's ability to resist viscosity change with temperature change is reflected in the viscosity index (VI). The greater the ability to resist viscosity change, the higher the VI of the lubricant. Because of their higher VIs, the HVI PAOs have an advantage over base fluids such as, for example, conventional PAOs, petroleum derived oils or mineral oils, unconventional base oils, ethylene-alpha-olefin polymers, perfluorinated polyether fluids, diesters, deuterated synthetic hydrocarbons, dimer acids, hydrocarbon polyethers, alkylene oxide polymers and interpolymers, esters of phosphorus containing acids, silicon based oils, polyol ester, and mixtures thereof.

HVI PAOs tend to have a higher heat capacity than other lubricant base stocks: about 0.51 for a typical HVI PAO, compared to about 0.47 for a typical alkyl nitrate and about 0.45 for a typical mineral oil. The higher heat capacity means that the rock bit will operate at a lower temperature while still preserving the seal and bearing surfaces.

HVI PAOs generally possess an average molecular weight of from about 300 to about 45000, a carbon number of from about 30 to 1000, and a viscosity at 100° C. of about 3 or less to about 5000 cSt or more. A particularly preferred number average molecular weight Mn for the HVI PAO is from about 3400 or lower to about 22000 or higher, more preferably from about 4,200 to about 20,900, and most preferably about 4200, 4850, 11050, or 20900. A particularly preferred molecular weight Mw for the HVI PAO is from about 4500 or lower to about 100000 or higher, more preferably from about 9940 to about 55100, and most preferably about 9940, 11900, 28200, or 55100. A particularly preferred Mw/Mn for the HVI PAO is from about 2 or lower to about 3 or higher, more preferably from about 2.36 to about 2.64, and most preferably about 2.36, 2.45, 2.55, or 2.64. The viscosity is preferably in the range of from about 100, 150, 300, 450, or 500 cSt to about 750, 1000, 1500, 2000, 2500, or 3000 cSt at 100° C. The branch ratio is preferably less than 0.19. The average side chain preferably comprises 8 or more carbon atoms. A particularly preferred HVI PAO for use in the grease formulations of preferred embodiments is marketed under the tradename SPECTRASYN ULTRA™ (formerly SUPERSYN™) by Exxon Mobil Corporation of Houston, Tex. The SPECTRASYN ULTRA™ fluids include SPECTRASYN ULTRA™ 150, 300, and 1000 cSt (at 100° C.) viscosity grades (corresponding to SUPERSYN™ 2150, SUPERSYN™ 2300, and SUPERSYN™ 21000).

The base fluid can contain as its sole component a single HVI PAO or a mixture of two or more HVI PAOs (e.g., of different viscosities, VI's, molecular weights, produced by different manufacturing processes, and the like). In certain embodiments, however, it can be preferred to combine one or more HVI PAOs with one or more other mineral or synthetic base fluids. When the base fluid comprises one or more base oils in addition to the HVI PAO, the HVI PAO generally constitutes from about 5 wt. % or less to about 99 wt. % or more of the base fluid mixture, preferably from about 10, 15, 20, 25, 20, 25, 30, 35, 40, or 45 wt. % to about 85, 90, or 95 wt. %, and more preferably about 50, 55, 60, or 65 wt. % to about 70, 75, or 80 wt. %. The total amount of synthetic fluid base oils included in the greases of preferred embodiments is generally 30 wt. % or less to 95 wt. % or more, preferably from about 35 or 40 wt. % to about 80 or 90 wt. %, and most preferably from about 50 or 60 wt. % to 70 wt. %. The greases of the preferred embodiments are preferably substantially free of mineral oils and other oils which tend not to be stable at higher temperatures. However, in certain embodiments it can be acceptable to include some such oils in the grease formulation. When such greases are present, they preferably constitute less than about 5 wt. % of the base oil mixture, more preferably less than about 4, 3, or 2 wt. % of the base oil mixture, and most preferably less than about 1, 0.5 or 0.1 wt. % of the base oil mixture.

Additional Base Fluids

In preferred embodiments, the HVI PAO is present in combination with one or more alkylated naphthalenes. Alkylated naphthalene (AN) is generally employed as additional base fluid to impart increased thermal and oxidative stability to the grease composition. See, e.g., U.S. Pat. No. 5,177,284. It is generally preferred to utilize mono substituted ANs rather than polysubstituted ANs because mono substituted ANs generally exhibit superior thermal and oxidative stability. See U.S. Pat. No. 5,457,254. While mono substituted ANs are generally preferred, in certain embodiments it can be acceptable to use polysubstituted ANs, for example, in situations wherein cost savings offset any stability reduction.

Similar to the ANs are the polymers of alkyl benzenes, such as dodecylbenzenes, tetradecylbenzenes, dinonylbenzenes, di-(2-ethyl-hexyl)-benzenes, and the like. Alkylated aromatics are formed by the reaction of olefins or alkyl halides with aromatic compounds, such as benzene. Thermal stability is similar to that of polyalphaolefins and unconventional base oils, and additives are typically used to provide oxidative stability.

As pressure increases, the viscosity of a fluid increases. For lubricants, some viscosity increase is advantageous because it prevents metal surfaces from touching each other. However, when the viscosity becomes excessive, it can deform the metal in the contact zone, leading to spalling, galling, and wear. ANs generally have a lower viscosity under pressure than mineral oils, making them better suited for use in high pressure applications. This difference is illustrated by comparing an AN to a mineral oil, both having a viscosity of 4 cSt at 100° C. and atmospheric pressure. When the pressure is increased to 80000 psi (while maintaining the temperature at 40° C.), the AN exhibits a viscosity of 80000 cSt compared to a viscosity in excess of 1000000 cSt for the mineral oil. At a viscosity of 1000000 cSt or higher, a tremendous amount of metal deformation can take place, which can lead to spalling, galling and wear of the metal surfaces. Accordingly, ANs are generally preferred over mineral oils for use as base fluids in greases exposed to the high loads and pressures that rock bit greases experience.

The lower viscosity of ANs also facilitates blending to almost any lubricant viscosity target when used in combination with the higher viscosity HVI PAOs. Generally, when a higher viscosity oil is blended with a lower viscosity oil, the VI of the resulting blend is greater than that expected for an additive effect based on the viscosities of the component oils (i.e., a synergistic effect on VI is observed for the blend).

The monosubstituted ANs generally preferred for use in greases of the preferred embodiments have a viscosity at 100° C. of from about 5 to about 13 cSt. Suitable ANs can be obtained from EXXON Mobil Corporation.

While ANs are generally preferred for use as additional base fluids, other mineral or synthetic fluids can also be employed, but preferably other mineral oils such as HVI paraffinic oils or synthetic fluids such as synthetic hydrocarbon fluids, polyol esters, dimer acids, polyethers, fluorinated polyethers, alkylene oxide polymers or interpolymers, esters of phosphorus containing acids, silicon based oils, and mixtures thereof are used. Especially preferred are lubricating base stocks known in the art to exhibit high thermal stability, for example, unconventional base oils, polyalphaolefins, dibasic acid esters, polyol esters, alkylated aromatics, polyalkylene glycols, and phosphate esters.

Unconventional Base Oils (UCBOs), such as those marketed by Chevron Texaco Company, can be advantageously employed as additional base fluids. UCBOs are hydroprocessed, highly refined paraffinic base oils. Relative to conventional hydroprocessed and solvent refined base oils, UCBOs have extremely low aromatics, sulfur and nitrogen levels, high resistance to oxidation and thermal degradation, very high viscosity indices, superior viscosity and film strength at high temperatures, substantially reduced volatility, and improved lubricity. UCBOs are compatible with a wide range of additives, and are preferred base oils for use in applications where high temperature performance is required. UCBOs can be blended with conventional base oils or polyalphaolefins. Preferred UCBO viscosity grades include 4 cSt at 100° C. and 7 cSt at 100° C. UCBOs are preferably present in greases of preferred embodiments at concentrations of from about 0.5 wt. % or less to about 65 wt. % or more, more preferably at concentrations of from about 1, 1.5, 2, 2.5, 3, 3.5, 4, 4.5, or 5 wt. % to about 40, 45, 50, 55, or 60 wt. %, and most preferably at from about 6, 7, 8, 9, or 10 wt. % to about 15, 20, 25, 30, or 35 wt. %.

One preferred class of synthetic fluid bases is that of synthetic polyolefins, particularly hydrogenated polyalphaolefins, although other synthetic polyolefins can be utilized as well. Examples of the synthetic hydrocarbon oils which can be utilized as additional synthetic fluid base oils for the greases of preferred embodiments are preferably saturated. Such oils can be prepared by polymerizing unsaturated monomers (e.g., ethylene) and hydrogenating the resulting polymer prior to use to remove any residual unsaturation from the oil. Examples of the saturated hydrocarbon and halo-substituted hydrocarbon oils include polyethylenes, polypropylenes, polybutylenes, propylene-isobutylene copolymers, chlorinated polybutylenes, poly(1-hexenes), poly(1-octenes), poly(1-decenes); polyphenyls such as biphenyls, terphenyls, alkylated polyphenyls, and the like; alkylated diphenyl ethers and alkylated diphenyl sulfides and derivatives, including deuterated and hydrogenated derivatives. The hydrogenated polyolefins derived from alphaolefins such as ethylene, propylene, 1-butene, and the like are especially preferred for use as additional synthetic base oils. In certain embodiments, however, it can be preferred to use a polyolefin derived from a branched chain monomer, for example, isobutylene. When a polyalphaolefin is employed as the low viscosity component in a grease base fluid comprising a HVI PAO, the polyalphaolefin preferably has a viscosity at 100° C. of about 4 cSt or lower to about 100 cSt or higher, more preferably of about 5, 6, 7, 8 or 9 cSt to about 30, 35, 40, 45, 50, 55, 60, 65, 70, 75, 80, 85, 90, or 95 cSt, and most preferably from about 10, 11, 12, 13, 14, or 15 cSt to about 16, 17, 18, 19, 20, 21, 22, 23, 24, 25, 26, 27, 28, or 29 cSt.

Dibasic acid esters also exhibit good thermal stability, but are usually also used in combination with additives for resistance to hydrolysis and oxidation. Polyol esters include molecules containing two or more alcohol moieties, such as trimethylolpropane, neopentylglycol, and pentaerythritol esters. Synthetic polyol esters are the reaction product of a fatty acid derived from either animal or plant sources and a synthetic polyol. Polyol esters have excellent thermal stability and generally resist hydrolysis and oxidation better than other base stocks. Naturally occurring triglycerides or vegetable oils are in the same chemical family as polyol esters. However, polyol esters tend to be more resistant to oxidation than such oils, and thus tend to function better under severe conditions and high temperatures. The instability normally associated with vegetable oils are generally due to a high content of linoleic and linolenic fatty acids, both unsaturated compounds. As the degree of unsaturation in the fatty acids in vegetable oils increases, the resulting esters tend to be less thermally stable.

Trimethylolpropane esters preferably include mono, di, and tri esters. Neopentyl glycol esters include mono and di esters. Pentaerythritol esters preferably include mono, di, tri, and tetra esters. Dipentaerythritol esters preferably include up to six ester moieties. Preferred esters are typically of those of long chain monobasic fatty acids. Esters of C20 or higher acids are preferred, e.g., gondoic acid, eicosadienoic acid, eicosatrienoic acid, eicosatetraenoic acid, eicosapentanoic acid, arachidic acid, arachidonic acid, behenic acid, erucic acid, docosapentanoic acid, docosahexanoic acid, or ligniceric acid. However in certain embodiments, esters of C18 or lower acids are preferred, e.g., butyric acid, caproic acid, caprylic acid, capric acid, lauric acid, myristoleic acid, myristic acid, pentadecanoic acid, palmitic acid, palmitoleic acid, hexadecadienoic acid, hexadecatienoic acid, hexadecatetraenoic acid, margaric acid, margroleic acid, stearic acid, linoleic acid, octadecatetraenoic acid, vaccenic acid, or linolenic acid. In certain embodiments, it is preferred to esterify the pentaerythritol with a mixture of different acids. Particularly preferred synthetic ester oils are the esters of trimethylol propane, trimethylol butane, trimethylol ethane, pentaerythritol and/or dipentaerythritol with one or more monocarboxylic acids containing from about 5 to 10 carbon atoms.

Polyol polyesters can be obtained by reacting various polyhydroxy compounds with carboxylic acids. When the carboxylic acids are dicarboxylic acids, monohydroxy compounds can be substituted for the polyols. For example, synthetic esters include the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, and the like. These dicarboxylic acids can be reacted with alcohols such as, for example, butanol, hexanol, dodecyl alcohol, 2-ethylhexyl alcohol, and the like. Specific examples of such esters include dibutyl adipate, di (2-ethylhexyl) sebacate, di-N-hexyl fumarate, dioctyl sebacate, diisooctyl azelate, diisodecyl azelate, dioctyl phthalate, didecyl phthalate, and the like. A particularly preferred polyol ester is HATCOL™ 2926 polyol ester of dipentaerythritol and short chain fatty acids.

When an ester or esters are employed in greases of preferred embodiments, they are preferably present at concentrations of from about 0.5 wt. % or less to about 70 wt. % or more, more preferably at concentrations of from about 1, 1.5, 2, 2.5, 3, 3.5, 4, 4.5, or 5 wt. % to about 40, 45, 50, 55, 60, or 65 wt. %, and most preferably at from about 6, 7, 8, 9, or 10 wt. % to about 15, 20, 25, 30, or 35 wt. %.

Phosphate esters are synthesized from phosphorus oxychloride and alcohols or phenols and also exhibit good thermal stability. Examples of esters of phosphorous-containing acids which are useful as the synthetic fluid bases in the greases of preferred embodiments include triphenyl phosphate, tricresyl phosphate, trixylyl phosphate, trioctyl phosphate, diethyl ester of decane phosphonic acid, and the like.

Silicon-based oils including siloxanes, such as polyalkylsiloxane, polyarylsiloxane, polyalkoxysiloxane, and polyaryloxysiloxane oils and silicone oils can also be suitable for use as additional base oils. Specific examples of some suitable polysiloxanes include methyl phenyl silicone, methyl tolyl silicone, methyl ethylphenyl silicone, ethyl phenyl silicone, propyl phenyl silicone, butyl phenyl silicone, and hexyl propylphenyl silicone.

Preferred silicon-based oils also include silicones such as alkyl phenyl silicones. The alkyl phenyl silicones can be prepared by hydrolysis and condensation reactions as are known in the art. Preferred alkyl groups for alkyl phenyl silicones include aliphatic groups, e.g., methyl, propyl, pentyl, hexyl, decyl, and the like; alicyclic groups, e.g., cyclohexyl, cyclopentyl, and the like; aryl groups, e.g., phenyl, naphthyl, and the like; aralkyl groups; and alkaryl groups, e.g., tolyl, xylyl, and the like; and halogenated, oxygen-containing, and nitrogen-containing organyl groups such as halogenated aryl groups, alkyl and aryl ether groups, aliphatic ester groups, organic acid groups, cyanoalkyl groups, and the like. The alkyl groups preferably contain from 1 to about 30 carbon atoms. Alkyl phenyl silicones are particularly preferred. Alkyl phenyl silicones are particularly preferred, especially those having a viscosity of from about 20, 25, 50, 75, 100, 125, or 150 cSt to about 200, 250, 500, 750, 1000, 1250, 1500, 1750, or 2000 cSt at 25° C.

Polyethers suitable for use as additional base oils can include polyphenyl ether fluids, preferably those containing from 3 to 7 benzene rings and from 2 to 6 oxygen atoms, wherein the oxygen atoms link the benzene rings, which can be hydrocarbyl-substituted. The hydrocarbyl substituents are preferably free of unsaturated hydrocarbon groups. Accordingly, the preferred aliphatic substituents include saturated hydrocarbon groups containing from 1 to 6 carbon atoms, such as ethyl, propyl, butyl, and t-butyl groups. Preferred aromatic substituents include aryl groups such as phenyl, tolyl, t-butyl phenyl, and alphacumyl. Polyphenyl ethers consisting exclusively of chains of from 3 to 7 benzene rings with at least two oxygen atom joining the benzene rings exhibit superior thermal stability, for example, the polyphenyl ethers such as 1-(p-methylphenoxy)-4-phenoxy benzene and 2,4-diphenoxy-1-methyl benzene; 4-ring polyphenyl ethers such as bis[p-(p-methylphenoxy) phenyl] ether and bis[p-(p-t-butylphenoxy) phenyl] ether, and the like. Such polyphenyl ethers can be prepared via the Ullmann ether synthesis and other ether-forming reactions as are known in the art.

Polyalkylene glycols (also referred to as polyalkylene oxides) are polymers of alkylene oxides which also exhibit good thermal stability, but which are typically used in combination with additives to provide oxidation resistance. Polyalkylene oxides and derivatives thereof wherein the terminal hydroxyl groups have been modified by esterification, etherification, and the like, also constitute a class of synthetic lubricating oils that can be utilized as a component of the base oil. These oils include those prepared through polymerization of ethylene oxide and propylene oxide, the alkyl and aryl ethers of these polyoxyalkylene polymers such as methyl polyisopropylene glycol ether having an average molecular weight of about 1000, diphenyl ether of polyethylene glycol having a molecular weight of about 500 to 1000, and diethyl ether of polypropylene glycol having a molecular weight of about 1000 to about 1500.

When one or more additional base oils are employed in combination with the HVI-PAO, the additional base oil or oils typically comprise from about 1 wt. % or less to about 80 wt. % or more of the grease, preferably from about 2, 5, 10, or 15 wt. % to about 60, 65, 70, or 75 wt. %, and most preferably from about 20, 25, or 30 wt. % to about 35, 40, 45, 50, or 55 wt. %.

Thickener

The greases of preferred embodiments are preferably thickened with a soap. The base grease soap thickener is preferably prepared by combining one or more fatty acids with a metal-containing component. Any suitable metal can be included in the metal-containing component. Particularly preferred metals include alkali metals (including, but not limited to lithium, sodium, and potassium), alkaline earth metals (including, but not limited to magnesium, strontium, and barium), Group VB metals (including, but not limited to, titanium), Group IIB metals (including, but not limited to zinc), Group IIIA metals (including, but not limited to aluminum), Group IVA metals (including, but not limited to lead), Group VA metals (including, but not limited to bismuth), and/or their hydroxides, oxides, and/or isopropoxides. The metal complex grease thickener preferably comprises from about 15 to about 35 wt. % of the total grease formulation.

Generally, it is preferred that the base oil blend (e.g., HVI PAO, AN, dipentaerythritol, and/or UCBO) is prepared, after which the reactants yielding the soap are added. However, in certain embodiments it can be desirable to alter the mixing process and/or parameters, or the sequence of addition of components, as is appreciated by one skilled in the art. For example, the reactants yielding the soap can be added separately to different base oil components, or different portions of the base oil blend, then the partially additized blend components can be mixed.

After the reactants yielding the grease are added to the base oil blend, the mixture is heated to saponify the grease. The reaction between the components results in a soap thickener yielding a heat resistant and shear stable grease. After the saponification reaction reaches a sufficient degree of completion, the grease is allowed to cool and the remaining additives are incorporated into the grease.

In preferred embodiments, the metal containing component is preferably an alkaline earth metal hydroxide, such as a hydroxide of lithium, barium, strontium, or calcium. Other metal hydroxides can also be employed, for example, aluminum hydroxide, titanium hydroxide, bismuth hydroxide, and barium hydroxide. Calcium hydroxide is especially preferred. Calcium hydroxide provides excellent water resistance and protection of the rock bit journal bearing surfaces against heavy loads.

Preferred fatty acids generally include those containing from 2 to 22 carbon atoms. The fatty acids react with the metal to form a complex structured soap. The in situ alkaline earth complex soap formation is a type of saponification reaction. Fatty acids containing from 2 to 22 carbon atom fatty acids generally yield a soap suitable for use in thickening a rock bit grease.

It is especially preferred to employ two or more fatty acids. The first fatty acid typically has from 10 or less to 22 or more carbon atoms. Fatty acids containing 18 carbon atoms are particularly preferred, especially 12-hydroxy stearic acid, wherein the —OH group is bonded to the twelfth carbon atom of the stearic acid. 12-Hydroxy stearic acid is generally favored because of its excellent shear stability, ready availability, and good oxidation resistance. However, in certain embodiments other fatty acids are preferred, including but not limited to gondoic acid, eicosadienoic acid, eicosatrienoic acid, eicosatetraenoic acid, eicosapentanoic acid, arachidic acid, arachidonic acid, behenic acid, erucic acid, docosapentanoic acid, docosahexanoic acid, ligniceric acid, butyric acid, caproic acid, caprylic acid, capric acid, lauric acid, myristoleic acid, myristic acid, pentadecanoic acid, palmitic acid, palmitoleic acid, hexadecadienoic acid, hexadecatienoic acid, hexadecatetraenoic acid, margaric acid, margroleic acid, stearic acid, linoleic acid, octadecatetraenoic acid, vaccenic acid, and linolenic acid.

One or more or more additional fatty acids can be employed to provide a more complex structure to the grease with increased cross-linking. Although, higher molecular weight acids can provide additional lubricity to the grease, they are generally inferior as additional complexing acids. Accordingly, one or more lower molecular weight fatty acids are used, preferably fatty acids containing from 2 to 10 carbon atoms, so as to provide greater cross-linking. Especially preferred is acetic acid.

To form the grease, the preferred alkaline earth (e.g., calcium) oxide or hydroxide is added to the base oil blend. Then, the fatty acids are added. The saponification reaction occurs upon heating the metal and fatty acids to a suitable temperature, typically about 175° C. The elevated temperature is then maintained, e.g., for about 20 minutes or until the reaction proceeds to a satisfactory degree of completion. The mixture is preferably stirred, either continuously or intermittently, during heating. After the resulting soap-containing mixture is cooled, the remaining additives are added.

The preferred metal complex soap thickener is a calcium complex in which the fatty acid complex is formed by the reaction of calcium hydroxide with several organic acids including acetic acid and 12-hydroxystearic acid. In certain embodiments, however, it can be acceptable to employ other thickener systems, including metal soap thickeners wherein the metal is aluminum, barium, calcium, lithium, sodium, potassium, magnesium, strontium, titanium, bismuth, or the like. Other thickener systems that can be used is silica gellant, modified clay, dye and pigment thickeners, thickeners such as carbon black, graphite, polytetrafluoroethylene (PTFE), polyurea, and the like. These other thickeners are preferably used in combination with the calcium soap described above. However, in certain embodiments they can be substituted for the calcium soap without impacting performance. Where seal integrity is a concern, it is desirable to avoid silica gels because of the negative impact such thickeners have on seal life.

In certain embodiments, bismuth soaps and/or zinc soaps can advantageously employed in combination with complex thickeners. For example, zinc naphthenate, bismuth naphthenate, lead naphthenate, bismuth 2-ethylhexanoate, or bismuth neodecanoate in combination with a sulfur donor generally provides 800 kg weld loads or greater in lithium and calcium complex greases. Such combinations are particularly preferred in greases for rock bit lubricant applications.

Solubility Additive

To improve the solubility of certain additives in the grease formulation, it is generally preferred to add one or more solubility improvers, such as an ester, to the grease. Polyol esters are generally preferred as solubility improving additives because of their extremely good thermal and oxidative stability, thus their addition to the formulation does not adversely affect the performance characteristics of the resulting grease. In certain embodiments, other solubility additives can be preferred. The solubility additive is preferably present at from about 0.5, 1, 1.5, 2, 2.5, 3, 3.5, 4, or 4.5 wt. % or less to about 20 wt. % or more, more preferably from about 5 or 10 wt. % to about 15 wt. %. When the solubility additive is also an additional base oil, then higher levels can be preferred.

Bismuth and Molybdenum EP Agents

Extreme Pressure (EP) agents, such as bismuth oxide, bismuth hydroxide, and molybdenum disulfide, provide wear protection under heavy loads. Accordingly, they are preferably added to the grease formulation. The added protection they provide results in longer service life for the lubricated drill bits. The EP additive or additives are generally present at levels of from about 0.1 wt. % or less to about 30 wt. % or more, preferably at from about 0.5, 1, 1.5, 2, 2.5, 3, 3.5, 4, 4.5, or 5 wt. % to about 16, 17, 18, 19, 20, 21, 22, 23, 24, 25, 26, 27, 28, or 29 wt. %, and more preferably at from about 6, 7, 8, 9, or 10 wt. % to about 11, 12, 13, 14, or 15 wt. %. Molybdenum disulfide is typically present at from about 1 wt. % or less to about 25 wt. % or more, preferably from about 2, 3, 4, or 5 wt. % to about 15, 16, 17, 18, 19, 20, 21, 22, 23, or 24 wt. %, and more preferably at from about 6, 7, 8, 9, or 10 wt. % to about 11, 12, 13, or 14 wt. %. Bismuth oxide or bismuth hydroxide is typically present at from about 1 wt. % or less to about 20 wt. % or more, preferably from about 2, 3, 4, or 5 wt. % to about 15, 16, 17, 18, or 19 wt. %, and more preferably at from about 6, 7, 8, 9, or 10 wt. % to about 11, 12, 13, or 14 wt. %. A single EP additive can be employed, or a combination of two or more EP agents can be employed.

Other Additives

Other additives as are known in the lubricating arts can also be employed in the greases of preferred embodiments. These include metal deactivators such as benzotriazole, which protect mostly nonferrous surfaces from corrosion. However, they can also improve the corrosion protection for ferrous surfaces. A preferred metal deactivator is substituted benzotriazole. Metal deactivators are preferably present at a concentration of from about 0.02 wt. % or less to about 5 wt. % or more, more preferably at from about 0.03, 0.04, 0.05, 0.06, 0.07, 0.08, 0.09, or 0.1 wt. % to about 4, 4.25, or 4.5 wt. %, and most preferably at from about 0.2, 0.3, 0.4, 0.5, 0.6, 0.7, 0.8, 0.9 or 1 wt. % to about 1.1, 1.2, 1.3, 1.4, 1.5, 1.6, 1.7, 1.8, 1.9, 2, 2.25, 2.5, 2.75, 3, 3.25, 3.5, or 3.75 wt. %.

Because there are preferably no additives, other than molybdenum disulfide, which contain sulfur in the greases of preferred embodiments, the seals and boots of the rock bit are generally unaffected by the grease additives. Typically, sulfur-containing components adversely affect the seals and boots of the rock bit, because sulfur causes further curing of the elastomers. Because molybdenum disulfide has a hexagonal crystalline structure, it does not react with the elastomers to promote further curing of the rubber.

A variety of other conventional solid additives, in addition to molybdenum disulfide, can be utilized with the grease formulations of preferred embodiments, including copper, lead, graphite, and the like. The grease compositions can also include conventional fillers, thickeners, thixotropic agents, extreme pressure additives, antioxidants, corrosion prevention materials, and the like. See, e.g., U.S. Pat. No. 3,935,114. The solid lubricant components can be added at any suitable step in the grease manufacturing process, for example, when the thickener is added if the thickener is not a metal soap type which is formed by a chemical reaction in the oil. Solid additives are preferably added to the grease with sufficient mixing, working, homogenizing, or the like, to ensure a complete, uniform, and thorough dispersion of solid particles. Preferably, solid lubricants are added to the grease after the thickener is formed or added.

The grease compositions of certain embodiments advantageously contain one or more antiwear agents. Preferred antiwear agents include long chain primary amines incorporating an alkyl or alkenyl radical having 8 to 50 carbon atoms. The amine to be employed can be a single amine or can consist of mixtures of such amines. Examples of long chain primary amines which can be used in the preferred embodiments are 2-ethylhexyl amine, n-octyl amine, n-decyl amine, dodecyl amine, oleyl amine, linolylamine, stearyl amine, eicosyl amine, triacontyl amine, pentacontyl amine and the like. Amines of the types indicated to be useful are well known in the art and can be prepared from fatty acids by converting the acid or mixture of acids to its ammonium soap, converting the soap to the corresponding amide by means of heat, further converting the amide to the corresponding nitrile and hydrogenating the nitrile to produce the amine. In addition to the various amines described, mixtures of amines derived from soya fatty acids also fall within the class of amines above described and are suitable for use. Especially preferred antiwear agents are straight chain, aliphatic primary amines. Those amines having 16 to 18 carbon atoms per molecule and being saturated or unsaturated are particularly preferred.

Other preferred antiwear agents include dimerized unsaturated fatty acids, preferably dimers of a comparatively long chain fatty acid, for example one containing from 8 to 30 carbon atoms, and can be pure, or substantially pure, dimers. Alternatively, and preferably, the material sold commercially and known as "dimer acid" can be used. This latter material is prepared by dimerizing unsaturated fatty acid and consists of a mixture of monomer, dimer and trimer of the acid. A particularly preferred dimer acid is the dimer of linoleic acid. Antiwear additives and agents are preferably present at a concentration of from about 0.1 wt. % or less to about 15 wt. % or more, more preferably from about 0.5, 1, 2, 3, 4, or 5 wt. % to about 6, 7, 8, 9, 10, 11, 12, 13, or 14 wt. %.

Various compounds known for use as oxidation inhibitors can be utilized in grease formulations of various embodiments. These include trimethyldihydroquinoline oligomers, phenolic antioxidants, amine antioxidants, sulfurized phenolic compounds, and organic phosphites, among others. It is especially preferred that the antioxidant includes predominately or entirely either a hindered phenol antioxidant such as 2,6-di-tert-butylphenol, 4-methyl-2,6-di-tert-butylphenol, 2,4-dimethyl-6-tert-butylphenol, 4,4'-methylenebis(2,6-di-tert-butylphenol), and mixed methylene bridged polyalkyl phenols, or an aromatic amine antioxidant such as the cycloalkyl-di-lower alkyl amines, and phenylenediamines, or a combination of one or more such phenolic antioxidants with one or more such amine antioxidants. Particularly preferred are combinations of tertiary butyl phenols, such as 2,6-di-tert-butylphenol, 2,4,6-tri-tert-butylphenol and o-tert-butylphenol. Also useful are N,N'-di-lower-alkyl phenylenediamines, such as N,N'-di-sec-butyl-p-phenylenediamine, and its analogs, as well as combinations of such phenylenediamines and such tertiary butyl phenols. Antioxidants, when employed, are preferably present at a concentration of from about 0.1 wt. % or less to about 2.5, 3, 3.5, 4, 4.5, or 5 wt. % or more, more preferably at from about 0.2 wt. % to about 2 wt. %, and most preferably from about 0.3, 0.4, 0.5, 0.6, 0.7, 0.8, or 0.9 wt. % to about 1.0, 1.1, 1.2, 1.3, 1.4, 1.5, 1.6, 1.7, 1.8, or 1.9 wt. %. In a particularly preferred embodiment, a grease contains from about 0.2 wt. % to about 2.0 wt. % of a phenolic antioxidant, an amine antioxidant, or a combination of a phenolic antioxidant and an amine antioxidant.

A variety of corrosion inhibitors are also available for use in the grease formulations of various embodiments, including dimer and trimer acids, such as are produced from tall oil fatty acids, oleic acid, linoleic acid, and the like. Other useful types of corrosion inhibitors are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols.

Also useful are the aminosuccinic acids or their derivatives. Preferably a dialkyl ester of an aminosuccinic acid is employed, wherein the alkyl group contains from 1 or 2 carbon atoms to about 20 carbon atoms or more, preferably from about 3, 4, 5, 6, 7, 8, 9, or 10 carbon atoms to about 11, 12, 13, 14, 15, 16, 17, or 18 carbon atoms.

Antiwear additives, antigalling additives, or solid film lubricant additives can advantageously be employed in greases of preferred embodiments. Suitable such additives include but are not limited to tungsten disulfide, boron nitride, monoaluminum phosphate, tantalum sulfide, iron telluride, zinconium sulfide, zinc sulfide, zinconium nitride, zirconium chloride, bismuth oxide, bismuth sulfate, calcium sulfate, calcium acetate, barium fluoride, lithium fluoride, chromium boride, chromium chloride, sodium tetraborate, and tripotassium borate. These compounds can be added to the lubricant in a suitable form, for example, a powder or liquid. Under operating conditions, these compounds can form reaction products or derivatives that exhibit antiwear, antigalling, or lubricating properties. Alternatively, precursors to these compounds can be added to the lubricant, which react under operating conditions to form an effective amount of the additive. When employed, such additives are typically present in grease formulations at from about 0.1 wt. % or less to about 10 wt. % or more, preferably from about 0.2, 0.4, 0.6, 0.8, 1, 1.25, 1.5, 1.75, or 2 wt. % to about 6, 7, 8, or 9 wt. %, and most preferably from about 2.5 or 3 wt. % to about 3.5, 4, 4.5, or 5 wt. %.

PTFE can also be added as a lubricating additive. PTFE is typically present at from 0.1 wt. % or less to about 8 wt. % or more, preferably at from 1, 1.5, 2, or 2.5 wt. % to about 3, 3.5, 4, 4.5, or 5 wt. %.

The various additives that can be included in the greases of preferred embodiments are used in conventional amounts. The amounts used in any particular case are preferably sufficient to provide the desired functional property to the grease composition, and such amounts are well known to those skilled in the art.

Grease Formulations

Dipentaerythritol esters and HVI PAOs exhibit superior thermal stability when compared to many conventional base oils. Accordingly, such base oils are preferred for use in rock bit grease and bearing lubricant formulations of preferred embodiments.

As discussed above, greases of preferred embodiments can include base fluid blends comprising a HVI PAO in combination with one or more additional base oils, for example, an alkylated naphthalene and/or polyol ester.

In certain embodiments, the grease includes a base fluid consisting only of one or more ester base oils thickened with a metal soap, preferably a calcium complex soap. Other suitable soaps include soaps of aluminum, titanium, barium, and lithium, and their complexes. Polyurea thickeners can also be employed, alone or in combination with a metal soap. Suitable ester base oils include those previously described. Preferred esters include pentaerythritol esters, dipentaerythritol esters, and trimellitic esters. A particularly preferred polyol ester is the ester of dipentaerythritol and one or more short chain or linear or branched chain fatty acids, such as HATCOL™ 2926 and HATCOL™ 2372 (from Hatco Corp. of Fords, N.J.). Suitable calcium complex soaps include those previously described. The calcium complex soap is typically present in such ester greases at from about 5 wt. % or less to about 45 wt. % or more of the total grease composition, preferably from about, 6, 7, 8, 9, 10, 11, 12, 13, 14, or 15 wt. % to about 35 or 40 wt. %, and more preferably from about 16, 17, 18, 19, 20, 21, 22, 23, or 24 wt. % to about 25, 26, 27, 28, 29, 30, 31, 32, 33, or 34 wt. %. Other additives such as those described above can also be incorporated into the ester grease formulations of preferred embodiments. Particularly preferred additives include antiwear additives, antirust additives, antioxidants, and metal deactivators. The ester greases of preferred embodiments are particularly well-suited for use in rock bit lubrication applications, however their superior performance at high temperatures also makes them suitable for use in high temperature bearing lubrication, such as in automotive applications.

EXAMPLES

Ester Grease

A grease was prepared employing HATCOL™ 2926 (a polyol ester of dipentaerythritol and short chain fatty acids) as the sole base stock in combination with a calcium complex base soap containing antioxidants. The components of the grease are listed in Table 2. HATCOL™ 2926 has a viscosity at 100° C. of 8.6-9.0 cSt, a viscosity at 40° C. of 53 cSt, a viscosity at −40° C. of 38000 cSt, a viscosity index of 135, a flash point at least 274° C., a pour point of no more than −40° C., a total acid number no higher than 0.05 mgKOH/g, and a water content of no more than 0.05 wt. %. The grease was tested in accordance with ASTM D-3336 "Performance Characteristics of Lubricating Greases in Ball Bearings at Elevated Temperatures", wherein a grease lubricated SAE No. 204 ball bearing is rotated at 10000 RPM under light load set at a specified temperature, wherein the test is generally run to failure. The test was conducted at 300° F., and the lubricant lasted over 700 hours without failure, at which time the test was ended. Under down hole drilling conditions, a rock bit generally operates from 100 to 300 hours. The test grease thus exhibited extremely good thermal and oxidative stability, desirable characteristics of a rock bit grease, as well as satisfactory high temperature performance.

TABLE 1

| Component | Weight Percent | Supplier |
|---|---|---|
| HATCOL ™ 2926 (a polyol ester of dipentaerythritol and short chain fatty acids) | 58.04 | Hatco. Corp |
| C8 Carboxylic Acid | 1.50 | Henkel |
| C10 Carboxylic Acid | 1.03 | Henkel |
| Triglyceride of 12-hydroxystearic acid | 0.39 | Arizona Chemical |
| C14 Carboxylic Acid | 0.13 | Witco |
| C16 Carboxylic Acid | 0.84 | Witco |
| C18 Carboxylic Acid | 1.16 | Witco |
| C20 & C22 Carboxylic Acids | 1.05 | Witco |
| Acetic Acid | 19.74 | Vopac |
| Hydrated calcium hydroxide (lime) | 14.18 | Mississippi Lime |
| Antioxidants | 1.94 | Ciba Geigy |

HVI PAO Greases

A grease formulation was prepared to contain the components as listed in Table 2.

TABLE 2

| Component | Weight Percent | Supplier |
|---|---|---|
| HVI PAO (SUPERSYN 2300, 298 cSt at 100° C.) | 25.4 | EXXONMobil |
| Alkylated Naphthalene (8.8 cSt at 100° C.) | 19.58 | EXXONMobil |
| C8 Carboxylic Acid | 1.16 | Henkel |
| C10 Carboxylic Acid | 0.8 | Henkel |
| Triglyceride of 12-hydroxystearic acid | 0.3 | Arizona Chemical |
| C14 Carboxylic Acid | 0.1 | Witco |
| C16 Carboxylic Acid | 0.65 | Witco |
| C18 Carboxylic Acid | 0.9 | Witco |
| C20 & C22 Carboxylic Acids | 0.81 | Witco |
| Acetic Acid | 15.3 | Vopac |
| Hydrated calcium hydroxide | 11 | Mississippi Lime |
| Antioxidants | 1.5 | Ciba Geigy |
| Hindered Dipentaerythritol Ester (HATCOL ™ 2372) | 1.5 | Hatco |
| Molybdenum disulfide | 14 | Climax |
| PTFE (Fluoro HP) | 3.5 | Shamrock |
| Bismuth Oxide | 3.5 | MCP |

The grease was prepared by combining the HVI-PAO, alkylated naphthalene, and polyol ester components to form a synthetic base oil blend. Lime (calcium hydroxide) was then added to the base oil blend, and then the fatty acids. This mixture was stirred and heated to 175° C. and maintained at that temperature for at least 20 minutes to effect saponification. After being allowed to cool to below 75° C., the remaining additives were added, including the antioxidant, molybdenum disulfide, PTFE, and bismuth oxide.

The grease exhibited superior performance, as demonstrated by the test results provided in Table 3.

The effects of HVI PAO viscosity on ASTM D-2596, Load Wear Index, and No Weld load were investigated. Each of Test Grease 1, containing a base oil mixture of 31% alkylated naphthalene and 69% SUPERSYN™ 2300 HVI PAO, Test Grease 2, containing a base oil mixture of 48.2% alkylated naphthalene and 51.8% SUPERSYN™ 2300 HVI PAO, and Test Grease 6, containing a base oil mixture of 81.8 wt. % 600 Neutral mineral oil and 18.2 wt. % SUPERSYN™ 2150 HVI-PAO did not weld, indicating superior high pressure and temperature performance. Test Grease 7, containing a base oil mixture of 46 wt. % hydroprocessed highly refined paraffinic base oils and 18.2 wt. % SUPERSYN™ 2300 HVI-PAO, also exhibited good high pressure and temperature performance, welding at 800 kg. The data suggest that a grease comprising HVI PAO in combination with an alkylated naphthalene, a mineral oil, or an unconventional base oil is well suited to use in high pressure and temperature applications.

Test Grease 3, containing a base oil mixture of similar viscosity to that of Test Greases 1 and 2, the base oil comprising dipentaerythritol, welded at 620 kg. Test Grease 4, containing a base oil mixture of similar viscosity to that of Test Greases 1 and 2, but including as a base oil a mixture of dipentaerythritol and SUPERSYN™ 2300 HVI PAO, also welded at 620 kg. Test Grease 5, including as a base oil a mixture of dipentaerythritol and a higher viscosity grade of HVI PAO (SUPERSYN™ 21000 HVI PAO) welded at 800 kg. The data suggest that superior high pressure and temperature performance may be achieved by employing a grease comprising a combination of an ester and a higher viscosity grade HVI PAO, although in certain applications a base oil mixture containing a lower viscosity grade of HVI PAO, or even a pure ester base oil, may exhibit satisfactory high pressure and temperature performance.

TABLE 3

| Test | Grease as Described in Table 2 | Typical Rock Bit Grease Properties (See U.S. Pat. No. 5,589,443) | Comments |
|---|---|---|---|
| NLGI Grade | 1 | 1.5 | The higher the number, the thicker the grease. Typical value is the average from rock bit manufacturers' specifications. |
| Worked penetration at 60 Stokes | 300 to 330 | 300 | The higher the penetration, the thinner the grease. Typical value is average from rock bit manufacturers' specifications. |
| Dropping point, ° F. | 572 | 384 | A higher dropping point signifies better high temperature operating capabilities. |
| Base oil viscosity, 40° C. | 460 | 100 | A higher viscosity provides better film strength to protect from wear. Typical value is the average from rock bit manufacturers' specifications. |
| Base oil pour point, ° F. | −31 | +15 | A lower pour point signifies lower operating temperature. Typical value is the average from rock bit manufacturers' specifications. |
| ASTM D-2596 four-ball weld load, KG | 800 (minimum) | 620 | A higher weld load correlates to better load carrying capability. |
| Four ball coefficient of friction | 0.07 | 0.09 | Generally, a lower coefficient of friction means less wear. |
| Modified ASTM D-2266, 5 minutes, 900 RPM, 500 KG, wear scar mm | 1.44 (maximum) | 1.65 | This is a Tomlin Scientific test. The lower value denotes less wear. |

Test results for grease formulations with various base oil viscosity blends, viscosity indices, and weld loads are tabulated in Table 4. Table 4.

TABLE 4

Test Grease 1

Base oil: alkylated naphthalene (31 wt. %) and HVI-PAO (SUPERSYN ™ 2300, 298 cSt @ 100° C.) (69 wt. %)
Thickener: calcium complex using C8 through C22 fatty acids
Molybdenum (14.2% solids in grease)
Bismuth oxide (7% solids in grease)
Visc. @ 40° C.: 1007 cSt (4666 SUS)
Visc. @ 100° C.: 100 cSt (466.6 SUS)
ASTM D-2596 weld load: 800+ kg (did not weld —grease exceeded capacity of machine)
ASTM D-2266 wear scar: 0.50 mm
Friction coefficient: 0.064

Test Grease 2

Base oil: alkylated naphthalene (48.2 wt. %) and HVI-PAO (SUPERSYN ™ 2300, 298 cSt @ 100° C.) (51.8 wt. %)
Thickener: calcium complex using C8 through C22 fatty acids
Molybdenum (14.2% solids in grease)
Bismuth oxide (7% solids in grease)
Visc. @ 40° C.: 484.7 cSt (2246 SUS)
Visc. @ 100° C.: 51 cSt (238.8 SUS)
ASTM D-2596 weld load: 800+ kg (did not weld —grease exceeded capacity of machine)
ASTM D-2266 wear scar: 0.60 mm
Friction coefficient: 0.062

Test Grease 3

Base oil: HATCOL ™ 2926 dipentaerythritol ester (8.8 cSt at 100° C.) (100 wt. %)
Thickener: calcium complex using C8 through C22 fatty acids
Molybdenum (14.5% solids in grease)
Bismuth oxide (7% solids in grease)
Visc. @ 40° C.: 53 cSt (246.4 SUS)
Visc. @ 100° C.: 8.8 cSt (55.1 SUS)
ASTM D-2596 weld load: 620 kg Test Grease 4

Base oil: HATCOL ™ 2926 dipentaerythritol ester (8.8 cSt at 100° C.) (55.5 wt. %) and HVI-PAO (SUPERSYN ™ 2300, 298 cSt @ 100° C.) (44.5 wt. %)
Thickener: calcium complex using C8 through C22 fatty acids
Molybdenum (14% solids in grease)
Bismuth oxide (7% solids in grease)
Visc. @ 40° C.: 455 cSt (2108 SUS)
Visc. @ 100° C.: 52.4 cSt (243.6 SUS)
ASTM D-2596 weld load: 620 kg Test Grease 5

Base oil: HATCOL ™ 2926 dipentaerythritol ester (8.8 cSt at 100° C.) (51.3 wt. %) and HVI-PAO (SUPERSYN ™ 21000, 1160 cSt @ 100° C.) (48.7 wt. %)
Thickener: calcium complex using C8 through C22 fatty acids
Molybdenum (14.5% solids in grease)
Bismuth oxide (7% solids in grease)
Visc. @ 40° C.: 1071.8 cSt (5000 SUS)
Visc. @ 100° C.: 100 cSt (466.6 SUS)
ASTM D-2596 weld load: 800 kg Test Grease 6

Base oil: 600 Neutral mineral oil (81.8 wt. %) and HVI-PAO (SUPERSYN ™ 2150, 145 cSt @ 100° C.) (18.2 wt. %)
Thickener: calcium complex using C8 through C22 fatty acids
Molybdenum (14.5% solids in grease)
Bismuth oxide (7% solids in grease)
Visc. @ 40° C.: 200 cSt (926.8 SUS)
Visc. @ 100° C.: 21.6 cSt (105.3 SUS)
ASTM D-2596 weld load: 800+ kg (did not weld —grease exceeded capacity of machine)

Test Grease 7

Base oil: hydroprocessed highly refined paraffinic base oils (Chevron UCBO 7R) (46 wt. %) and HVI-PAO (SUPERSYN ™ 2300, 298 cSt @ 100° C.) (18.2 wt. %)
Thickener: calcium complex using C8 through C22 fatty acids
Molybdenum (14% solids in grease)
Bismuth oxide (7% solids in grease)
Visc. @ 40° C.: 476.9 cSt (2209 SUS)
Visc. @ 100° C.: 55 cSt (256.5 SUS)
ASTM D-2596 weld load: 800 kg A vast number and variety of rock bits can be satisfactorily lubricated with grease compositions of preferred embodiments. The greases of preferred embodiments can also comprise a variety of additives not specifically mentioned above. For example, the grease can contain types of extreme pressure agents, corrosion inhibitors, oxidation inhibitors, anti-wear additives, pour point depressants, and thickening agents not enumerated above. In addition, the grease composition can comprise additives not specifically mentioned such as water repellants, anti-foam agents, color stabilizers, and the like. Also, while the greases of preferred embodiments can be particularly well suited for rock bit lubrication, they can also be suitable for use in other applications, such as bearing lubrication, for example, automotive bearing lubrication (e.g., lubrication of belt tensioner bearings, bearings for fan belts, water pumps, and other under-the-hood engine components), other high temperature and/or high speed bearing lubrication applications, and the like. The greases of preferred embodiments are suitable for use as multipurpose greases in many high temperature applications.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims. All patents, applications, and other references cited herein, are hereby incorporated by reference in their entirety.

What is claimed is:

1. A grease composition for lubricating a rock bit for drilling subterranean formations or for lubricating a high temperature bearing, the grease comprising:

a high viscosity index polyalphaolefin base fluid, wherein the polyalphaolefin contains an average of 30 to 100 carbon atoms, a branching ratio of less than about 0.19, and an average side chain length of 8 or more carbon atoms, wherein the high viscosity index polyalphaolefin base fluid comprises from about 15 wt. % to about 85 wt. % of the grease composition;

an additional base fluid selected from the group consisting of monosubstituted alkyl naphthalenes, polysubstituted alkyl naphthalenes, and mixtures thereof, wherein the alkyl comprises from about 16 to about 30 carbon atoms, wherein the additional base fluid comprises from about 15 wt. % to about 85 wt. % of the grease composition;

an ester base fluid, the ester comprising from about 5 to about 20 carbon atoms, wherein the ester base fluid comprises from about 0.5 wt. % to about 5 wt. % of the grease composition;

a metal complex soap, the soap comprising a residue of one or more fatty acids comprising from 2 to 22 carbon atoms, wherein the metal is selected from the group consisting of calcium, lithium, sodium, barium, titanium, and mixtures thereof, wherein the metal soap comprises from about 5 wt. % to about 45 wt. % of the grease composition;

an antioxidant, wherein the antioxidant comprises from about 0.2 wt. % to about 2 wt. % of the grease composition;

a metal deactivator, wherein the metal deactivator comprises from about 0.1 wt. % to about 1.5 wt. % of the grease composition;

an antiwear agent, wherein the antiwear agent comprises from about 0.1 wt. % to about 15 wt. % of the grease composition; and a bismuth oxide extreme pressure additive, wherein the bismuth oxide extreme pressure additive comprises from about 1 wt. % to about 20 wt. % of the grease composition.

2. A grease composition for lubricating a rock bit for drilling subterranean formations or for lubricating a high temperature bearing, the grease comprising a high viscosity index polyalphaolefin, wherein the high viscosity index polyalphaolefin has a branching ratio of less than about 0.19, further comprising from about 1 wt. % to about 20 wt. % of a bismuth oxide extreme pressure additive.

3. The grease composition of claim 2, further comprising a naphthalene substituted by an alkyl group.

4. The grease composition of claim 3, wherein the naphthalene is substituted by a single alkyl group.

5. The grease composition of claim 3, wherein the alkyl group comprises from about 16 to about 30 carbon atoms.

6. The grease composition of claim 3, wherein the grease comprises from about 30 wt. % to about 80 wt. % of the naphthalene substituted by an alkyl group.

7. The grease composition of claim 2, further comprising an additional base stock selected from the group consisting of ethylene-alphaolefin polymer, a paraffinic mineral oil, a hydroprocessed and highly refined paraffinic base oil, and mixtures thereof.

8. The grease composition of claim 2, further comprising a metal complex soap.

9. The grease composition of claim 2, further comprising a copper powder anti-seize agent.

10. The grease composition of claim 2, further comprising a molybdenum disulfide extreme pressure additive.

11. A grease composition for lubricating a rock bit for drilling subterranean formations or for lubricating a high temperature bearing, the grease comprising a high viscosity index polyalphaolefin, wherein the high viscosity index polvalphaolefin has an average side chain length of 8 or more carbon atoms, further comprising an anti-seize agent, wherein the anti-seize agent comprises copper powder.

12. The grease composition of claim 11, wherein a number average molecular weight Mn of the high viscosity index polyatphaolefin is from about 3400 to about 22000.

13. The grease composition of claim 11, wherein the grease comprises from about 20 wt. % to about 50 wt. % of the high viscosity index polyalphaolefin.

14. The grease composition of claim 11, further comprising an ester base fluid.

15. The grease composition of claim 14, wherein the ester comprises from about 5 to about 20 carbon atoms.

16. The grease composition of claim 14, wherein the grease comprises from about 0.5 wt. % to about 5 wt. % of the ester base fluid.

17. The grease composition of claim 11, further comprising a metal complex soap.

18. The grease composition of claim 17, wherein the metal complex soap is derived from a fatty acid comprising from about 2 to about 22 carbon atoms.

19. The grease composition of claim 17, wherein the grease comprises from about 5 wt. % to about 45 wt. % of the metal complex soap.

20. The grease composition of claim 17, wherein the metal is selected from the group consisting of alkaline earth metals, alkali metals, Group IIB metals, Group IIIA metals, Group IVA metals, Group VA metals, Group IVB metals, Group VB metals, and mixtures thereof.

21. The grease composition of claim 17, wherein the metal is selected from the group consisting of lithium, sodium, potassium, magnesium, strontium, barium, aluminum, titanium, bismuth, and mixtures thereof.

22. The grease composition of claim 20, wherein the metal comprises calcium.

23. The grease composition of claim 20, wherein the metal comprises a compound selected from the group consisting of metal hydroxides, metal oxides, metal isopropoxides, and mixtures thereof.

24. The grease composition of claim 11, wherein the grease comprises a non-soap thickener.

25. The grease composition of claim 24, wherein the non-soap thickener selected from the group consisting of a polyurea thickener, a silica gellant, a polytetrafluoroethylene, a clay, and mixtures thereof.

26. The grease composition of claim 24, wherein the grease comprises from about 3 wt. % to about 40 wt. % non-soap thickener.

27. The grease composition of claim 11, further comprising from about 0.2 wt. % to about 2 wt. % of an antioxidant.

28. The grease composition of claim 11, further comprising from about 0.2 wt. % to about 2 wt. % of a phenolic antioxidant.

29. The grease composition of claim 11, further comprising from about 0.2 wt. % to about 2 wt. % of an amine antioxidant.

30. The grease composition of claim 11, further comprising from about 0.02 wt. % to about 1.5 wt. % of a metal deactivator selected from the group consisting of substituted benzotriazole, derivatives of substituted benzotriazole, and mixtures thereof.

31. The grease composition of claim 30, wherein the metal deactivator consists essentially of benzotriazole.

32. The grease composition of claim 30, wherein the grease comprises from about 0.02 wt. % to about 1.5 wt. % benzotriazole.

33. The grease composition of claim 11, further comprising from about 2 wt. % to about 25 wt. % of a molybdenum disulfide extreme pressure additive.

34. The grease composition of claim 11, further comprising from about 1 wt. % to about 30 wt. % of an extreme pressure additive.

35. The grease composition of claim 11, wherein the grease comprises from about 3 wt. % to about 9 wt. % of the anti-seize agent.

36. The grease composition of claim 11, further comprising a polytetrafluoroethylene antiwear agent.

37. A method for lubricating a rock bit for drilling subterranean formations, the rock bit comprising a body and a plurality of cutter cones mounted, the cutter cones mounted on the body, the rock bit comprising a journal bearing in contact with a grease reservoir, the method comprising:

evacuating a portion of the rock bit comprising the journal bearing; and introducing a grease into the evacuated area, the grease comprising a high viscosity index polyalphaolefin, wherein the polyalphaolefin has an average side chain length of 8 or more carbon atoms.

38. The method of claim 37, wherein the grease further comprises an additional base stock selected from the group consisting of ethylene-alphaolefin polymer, a paraffinic mineral oil, a hydroprocessed and highly refined paraffinic base oil, and mixtures thereof.

39. The method of claim 37, wherein the grease further comprises a metal complex soap.

40. The method of claim 39, wherein the metal complex soap is derived from a fatty acid comprising from about 2 to about 22 carbon atoms.

41. The method of claim 39, wherein the metal comprises calcium.

42. The method of claim 39, wherein the metal comprises a compound selected from the group consisting of metal hydroxides, metal oxides, metal isopropoxides, and mixtures thereof.

43. The method of claim 37, wherein the grease further comprises a copper powder anti-seize agent.

44. The method of claim 37, further comprising a polytetrafluoroethylene antiwear agent.

45. The method of claim 37, further comprising a bismuth oxide extreme pressure additive.

46. The method of claim 37, further comprising a molybdenum disulfide extreme pressure additive.

47. A grease composition for lubricating a rock bit for drilling subterranean formations or for lubricating a high temperature bearing, the grease comprising a high viscosity index polyalphaolefin, wherein the high viscosity index polyalphaolefin has an average side chain length of 8 or more carbon atoms further comprising a bismuth oxide extreme pressure additive.

48. The grease composition of claim 47, further comprising an additional base stock selected from the group consisting of ethylene-alphaolefin polymer, a paraffinic mineral oil, a hydroprocessed and highly refined paraffinic base oil, and mixtures thereof.

49. The grease composition of claim 47, further comprising a metal complex soap.

50. The grease composition of claim 49, wherein the metal complex soap is derived from a fatty acid comprising from about 2 to about 22 carbon atoms.

51. The grease composition of claim 49, wherein the metal comprises calcium.

52. The grease composition of claim 49, wherein the metal comprises a compound selected from the group consisting of metal hydroxides, metal oxides, metal isopropoxides, and mixtures thereof.

53. The grease composition of claim 47, further comprising a molybdenum disulfide extreme pressure additive.

54. The grease composition of claim 8, wherein the metal complex soap is derived from a fatty acid comprising from about 2 to about 22 carbon atoms.

55. The grease composition of claim 8, wherein the metal comprises calcium.

56. The grease composition of claim 8, wherein the metal comprises a compound selected from the group consisting of metal hydroxides, metal oxides, metal isopropoxides, and mixtures thereof.

57. A grease composition for lubricating a rock bit for drilling subterranean formations or for lubricating a high temperature bearing, the grease comprising a high viscosity index polyalphaolefin, wherein the high viscosity index polyalphaolefin has a branching ratio of less than about 0.19, further comprising a naphthalene substituted by an alkyl group, further comprising a copper powder anti-seize agent.

58. A grease composition for lubricating a rock bit for drilling subterranean formations or for lubricating a high temperature bearing, the grease comprising a high viscosity index polyalphaolefin, wherein the high viscosity index polyalphaolefin has a branching ratio of less than about 0.19, further comprising a naphthalene substituted by an alkyl group, further comprising a polytetrafluoroethylene antiwear agent.

59. A grease composition for lubricating a rock bit for drilling subterranean formations or for lubricating a high temperature bearing, the grease comprising a high viscosity index polyalphaolefin, wherein the high viscosity index polyalphaolefin has a branching ratio of less than about 0.19, further comprising a naphthalene substituted by an alkyl group, further comprising a bismuth oxide extreme pressure additive.

60. A grease composition for lubricating a rock bit for drilling subterranean formations or for lubricating a high temperature bearing, the grease comprising a high viscosity index polyalphaolefin, wherein the high viscosity index polyalphaolefin has a branching ratio of less than about 0.19, further comprising from about 0.1 wt. % to about 8 wt. % of a polytetrafluoroethylene antiwear agent, further comprising an additional base stock selected from the group consisting of ethylene-alphaolefin polymer, a paraffinic mineral oil, a hydroprocessed and highly refined paraffinic base oil, and mixtures thereof.

61. The grease composition of claim 60, further comprising a metal complex soap.

62. The grease composition of claim 61, wherein the metal complex soap is derived from a fatty acid comprising from about 2 to about 22 carbon atoms.

63. The grease composition of claim 61, wherein the metal comprises calcium.

64. The grease composition of claim 61, wherein the metal comprises a compound selected from the group consisting of metal hydroxides, metal oxides, metal isopropoxides, and mixtures thereof.

65. A grease composition for lubricating a rock bit for drilling subterranean formations or for lubricating a high temperature bearing, the grease comprising a high viscosity index polyalphaolefin, wherein the high viscosity index polyalphaolefin has a branching ratio of less than about 0.19. further comprising from about 0.1 wt. % to about 8 wt. % of a polytetrafluoroethylene antiwear agent, further comprising a copper powder anti-seize agent.

66. The grease composition of claim 65, further comprising a molybdenum disulfide extreme pressure additive.

* * * * *